US008393483B2

(12) United States Patent
Druitt

(10) Patent No.: US 8,393,483 B2
(45) Date of Patent: Mar. 12, 2013

(54) SEALING MEANS FOR CLOSURE WITH MULTIPLE SEALING AREAS

(75) Inventor: Rodney Druitt, Bath and South East Somerset (GB)

(73) Assignee: Creanova Universal Closure Ltd. (GB)

( * ) Notice: Subject to any disclaimer, the term of this patent is extended or adjusted under 35 U.S.C. 154(b) by 782 days.

(21) Appl. No.: 11/574,569

(22) PCT Filed: Aug. 2, 2005

(86) PCT No.: PCT/EP2005/053777
§ 371 (c)(1),
(2), (4) Date: Oct. 25, 2007

(87) PCT Pub. No.: WO2006/117024
PCT Pub. Date: Nov. 9, 2006

(65) Prior Publication Data

US 2008/0067142 A1 Mar. 20, 2008

Related U.S. Application Data

(60) Provisional application No. 60/661,983, filed on Mar. 14, 2005, provisional application No. 60/606,240, filed on Sep. 1, 2004.

(30) Foreign Application Priority Data

Apr. 7, 2005 (WO) ..... PCT/EP2005/051559
Apr. 8, 2005 (WO) ..... PCT/EP2005/051575

(51) Int. Cl.
*B65D 53/02* (2006.01)
*B65D 39/08* (2006.01)
*B65D 41/38* (2006.01)

(52) U.S. Cl. ..... 215/344; 215/252; 215/329; 215/345

(58) Field of Classification Search ..... 215/344, 215/345, 252, 329
See application file for complete search history.

(56) References Cited

U.S. PATENT DOCUMENTS 3,360,149 A * 12/1967 Roth ..... 215/344
3,441,161 A * 4/1969 Van Baarn ..... 215/235
3,463,340 A * 8/1969 Lindstrom ..... 215/330
4,033,472 A * 7/1977 Aichinger ..... 215/256
4,143,785 A * 3/1979 Ferrell ..... 215/270
4,322,012 A * 3/1982 Conti ..... 215/344
4,386,712 A * 6/1983 DeWallace ..... 215/211
(Continued)

FOREIGN PATENT DOCUMENTS

CH 410 655 11/1963
EP 0 076 778 4/1983
(Continued)

OTHER PUBLICATIONS

International Search Report PCT/EP2005/053777 dated Dec. 7, 2005 (European Patent Office).

*Primary Examiner* — J. Gregory Pickett
*Assistant Examiner* — Ned A Walker
(74) *Attorney, Agent, or Firm* — Ostrolenk Faber LLP

(57) ABSTRACT

The present invention is directed to a sealing means for sealing of a neck of a container, especially a container for carbonated beverages. The sealing means comprises a radially deformable outer sealing means suitable to be engaged with an outer free surface of a neck of the container. The outer sealing means comprises an annular base which blends by a blend into a vertical top surface and at least one annular sealing ring arranged at a free end of the annular base, protruding radially inwardly above the inner surface of the base and forming in engaged position with the neck a first contact area with the outer free surface.

16 Claims, 4 Drawing Sheets

U.S. PATENT DOCUMENTS

| | | | | | |
|---|---|---|---|---|---|
| 4,489,844 | A | | 12/1984 | Breskin | 215/329 |
| 4,489,845 | A | | 12/1984 | Aichinger et al. | 215/329 |
| 4,560,077 | A | * | 12/1985 | Dutt | 215/307 |
| 4,566,603 | A | * | 1/1986 | Moore | 215/329 |
| 4,592,476 | A | * | 6/1986 | Yasada | 215/252 |
| 4,598,835 | A | | 7/1986 | Brownbill | 215/307 |
| 4,638,917 | A | * | 1/1987 | Persch | 215/252 |
| 4,667,838 | A | * | 5/1987 | Yeager | 215/252 |
| 4,913,493 | A | | 4/1990 | Heidmann | |
| 5,297,688 | A | * | 3/1994 | Beck et al. | 215/344 |
| 5,421,470 | A | * | 6/1995 | Dudzik | 215/350 |
| 5,447,674 | A | | 9/1995 | Schellenbach | 264/255 |
| 5,535,802 | A | | 7/1996 | Chambers | |
| 5,573,128 | A | * | 11/1996 | Tsujiguchi et al. | 215/252 |
| 5,725,116 | A | * | 3/1998 | Takai | 215/252 |
| 5,794,308 | A | | 8/1998 | Rentsch et al. | |
| 5,803,286 | A | * | 9/1998 | Pfefferkorn et al. | 215/307 |
| 5,913,436 | A | * | 6/1999 | Breuer | 215/252 |
| 6,021,912 | A | * | 2/2000 | Hertrampf | 215/344 |
| 6,041,477 | A | | 3/2000 | Rentsch et al. | |
| 6,126,027 | A | | 10/2000 | Thompson | 215/354 |
| 6,260,721 | B1 | * | 7/2001 | Ohmi et al. | 215/256 |
| 6,325,226 | B1 | * | 12/2001 | Krautkramer | 215/252 |
| 6,338,414 | B1 | * | 1/2002 | Schellenbach | 215/252 |
| 6,581,793 | B1 | * | 6/2003 | Racine et al. | 215/350 |
| 6,634,060 | B1 | | 10/2003 | Lagler et al. | |
| 6,679,395 | B1 | * | 1/2004 | Pfefferkorn et al. | 215/307 |
| 6,695,161 | B2 | * | 2/2004 | Kano et al. | 215/341 |
| 6,779,672 | B2 | * | 8/2004 | Kano et al. | 215/344 |
| 7,014,055 | B2 | * | 3/2006 | Kano et al. | 215/344 |
| 7,264,131 | B2 | * | 9/2007 | Tsutsumi et al. | 215/344 |
| 7,503,468 | B2 | * | 3/2009 | Druitt et al. | 222/344 |
| 7,575,121 | B2 | * | 8/2009 | Ooka et al. | 215/344 |
| 7,651,004 | B2 | * | 1/2010 | Fuchs | 215/344 |
| 2001/0027957 | A1 | * | 10/2001 | Kano | 215/341 |
| 2002/0158037 | A1 | | 10/2002 | Kano et al. | 215/341 |
| 2004/0060893 | A1 | * | 4/2004 | Kano et al. | 215/344 |
| 2004/0069739 | A1 | * | 4/2004 | Zumbuhl | 215/349 |
| 2004/0238478 | A1 | * | 12/2004 | Druitt et al. | 215/344 |
| 2005/0140053 | A1 | * | 6/2005 | Lai et al. | 264/255 |
| 2006/0255003 | A1 | * | 11/2006 | Fuchs | 215/252 |
| 2009/0159555 | A1 | * | 6/2009 | Druitt et al. | 215/344 |

FOREIGN PATENT DOCUMENTS

| | | | |
|---|---|---|---|
| EP | 0076778 | | 4/1983 |
| EP | 0 114 127 | | 7/1984 |
| EP | 0114127 | | 7/1984 |
| EP | 0 176 205 | | 4/1986 |
| EP | 0176205 | | 4/1986 |
| EP | 0309369 | | 8/1988 |
| EP | 0532471 | | 9/1992 |
| EP | 0 529 383 | A2 | 3/1993 |
| EP | 0529383 | | 3/1993 |
| EP | 0746512 | | 2/1995 |
| EP | 0 770 559 | A1 | 5/1997 |
| EP | 0770559 | | 5/1997 |
| EP | 0685406 | | 4/1998 |
| EP | 1075432 | | 1/1999 |
| EP | 1 600 394 | A1 | 11/2005 |
| EP | 1582475 | | 11/2007 |
| FR | 2715381 | | 7/1995 |
| JP | 08324610 | A2 | 12/1996 |
| JP | 10035699 | A2 | 2/1998 |
| JP | 2000109105 | | 3/2000 |
| JP | 2000079954 | | 4/2000 |
| JP | 2002145312 | A2 | 5/2002 |
| NZ | 502482 | | 4/2001 |
| WO | WO 85/00153 | | 1/1985 |
| WO | WO 89/12584 | | 12/1989 |
| WO | WO89/12584 | | 12/1989 |
| WO | WO 99/03746 | | 1/1999 |
| WO | WO99/03746 | | 1/1999 |
| WO | WO99/03747 | | 1/1999 |
| WO | WO 99/03747 | | 1/1999 |
| WO | WO 00/44639 | | 10/1999 |
| WO | WO 00/56615 | | 9/2000 |
| WO | WO00/56615 | | 9/2000 |
| WO | WO 00/56616 | | 9/2000 |
| WO | WO00/56616 | | 9/2000 |
| WO | WO 02/032775 | | 10/2002 |
| WO | WO03011699 | | 2/2003 |
| WO | WO03/022701 | | 3/2003 |
| WO | WO 03/022701 | A1 | 3/2003 |

* cited by examiner

SEALING MEANS FOR CLOSURE WITH MULTIPLE SEALING AREAS

CROSS REFERENCE TO RELATED APPLICATION

The present application is a 35 U.S.C. §371 national phase conversion of PCT/EP2005/053777 filed 2 Aug. 2005, which claims priority of U.S. Provisional Patent Application No. 60/606,240 filed 1 Sep. 2004, U.S. Provisional Patent Application No. 60/661,983 filed 14 Mar. 2005, PCT/EP2005/051559 filed 7 Apr. 2005, and PCT/EP2005/051575 filed 8 Apr. 2005 which are herein incorporated by reference. The PCT International Application was published in the English Language.

BACKGROUND OF THE INVENTION

1. Field of the Invention

The invention relates to a sealing means for closures, especially sealing means for closures for packages for liquids such as beverages. In particular the invention relates to a sealing means for containers for carbonated liquids such as soft drinks but is well adapted to seal other containers such as glass or PET containers with contents at above or below atmospheric pressure or having gaseous components or requiring a hermetic seal. The invention further relates to a closure and a process for making and applying of a sealing means, respectively a closure.

2. Description of the Art

Seals of closures are generally manufactured from several types of plastic, such as Polyethylene (from now on PE) or Polypropylene (from now on PP) or EVA-based materials such as Darex™ liner material. The latter is mainly used for the manufacture of liner closures; the material is less hard and less durable than PE. Softer material such as Low density PE (LDPE), ethylene vinyl acetate (EVA) or compounds based on polyolefine raw materials are often used as sealing material. More rigid materials such as Polypropylene are often used as a shell material of closures.

From prior art a vast amount of documents is available which are directed to closures and caps for sealing of containers. A selected range is explained subsequent.

EP0076778 of Albert Obrist AG was filed in 1982 and is directed to a closure cap made of plastics material which has a circular outer sealing lip having a thickness which continuously decreases versus its free end. The outer sealing lip is arranged in the region of the joint between an outer vertical skirt and a disc like top portion and points obliquely inwards. At its smallest diameter, the sealing lip has a rounded sealing portion. Below the sealing portion the sealing lip is widened outwards in the manner of a funnel to receive a container opening. However, due to the obliged arrangement of the sealing lip the sealing lip often tends to be distorted during application, especially crooked application onto a neck of a container. A further disadvantage consists in that due to the inclined arrangement this seal is relatively rigid and therefore not very good in adjusting in lateral direction.

U.S. Pat. No. 4,489,845 was filed in 1984 and assigned to Albert Obrist AG. U.S. Pat. No. 4,489,845 is directed to a screw-cap for closing a container opening. The cap has a sealing lip which is affixed to the cap top. The inner side-wall of the outer sealing lip has a diameter which is greater than the outer diameter of the container outer wall. A clamping device, which can be designed as an inner seal, creates a contraction of the cap top when the screw-cap is screwed onto the container due to deformation of the outer shell of the closure, by which means the sealing lip shall be pressed against the container mouth. In this manner the sealing lip is only pressed radially against the container mouth during the course of the screwing-on process. Thereby over-stretching and damage to the material of the sealing lip shall be prevented. In an engaged position the sealing lip engages around the upper outer rim of the neck of a container opening. One disadvantage is that the described deformation of the closure is related to extensive operating forces. A further disadvantage consists in that the outer shell tends to break due to extensive stress and deformation (stress cracking) which results in complete failure of the closure and loss of the product.

EP0114127, filed in 1984, of Continental Whitecap and EP0176205, filed in 1985, of Sun Cost Plastic both disclose a seal having two sealing flaps arranged in general V-shape. When the closure is drawn down onto a container, the flaps will deform in accordance with the cross section of the sealing surface area of the container including down inside of the mouth of the container and down along-side the exterior surface of the neck finish to provide effective sealing contact with the container sealing area. The sealing flaps are in engaged position laterally supported and pressed against the neck of the closure.

EP0529383, filed in 1992 by Jacob Berg GmbH, is directed to a plastic screw cap for containers, in particular pressurised beverage containers. The closure comprises an annular sealing strip which is integrally moulded with the shell of the closure. Adjacent to the sealing strip a bead is arranged pressing the sealing strip against an upper outer edge of the neck of a container. One disadvantage consists in the reduced lateral adjustability.

EP0770559, filed in 1996 by Sacmi Cooperativa Meccanici, is directed to a plastic screw cap with a liner made by compression moulding. The closure comprises an annular lip that is designed to support a liner and protrudes from the disk-like portion concentrically with respect to the cylindrical outer wall. The annular lip is acting as a shoulder for a sealing liner, so that the liner, when the cap has been applied to the container, engages to the rim of the mouth of the container.

U.S. Pat. No. 4,489,844 was filed in 1982 and assigned to Charles A. Breskin Assoc. Inc. is directed to a reusable cap for closing carbonated beverage containers or the like. The closure consists of an internally threaded shell having a fitment therein which sealingly engages the neck of the beverage container at the free edge thereof. The shell and the fitment are constructed of different plastic materials and are injection moulded in different portions of the same moulding cavity. First, the fitment is formed and then, without moving the fitment from the position in which it was formed, the shell is formed, to produce a unitary structure in which substantial portions of the fitment are imbedded in the shell.

U.S. Pat. No. 5,447,674 filed in 1993 by Frank Schellenbach is directed to a method and a mould core for the production of two-component injection moulded plastic closure. A mould core for use in a two-component injection moulding method is presented for two-component injection moulding of plastic closures for containers. The mould core consists of first and second sub-core. After injecting the first substance, one sub-core or tool element is displaced by a predetermined amount relative to the first moulding. One disadvantage of the described procedure is that displacement of the core can only take place when the material of the first stage has sufficiently congealed which results in a significant delay. A further disadvantage consists in that the geometry of the closure and the seal is significantly restricted due to the mould function. A still further disadvantage is that the seal may not comprise a radial protrusion which would result in an undercut the mould because displacement of the mould core would not be possible anymore.

WO03011699 filed in 2002 by Bericap is directed to a closure cap comprising an internal sealing skirt which is substantially truncated and converges from the sealing skirt base towards the free end of the sealing skirt. The inside of the sealing skirt is designed to cooperate with the outside of the neck. The internal diameter of the sealing skirt towards its free end portion is designed smaller than the external diameter of the neck. As described the closure can comprise an annular v-notch designed to improve attachment of a liner to the rim of the neck or contact between the liner and the rim.

From the inventor of the herein disclosed invention a series of closures for carbonated beverage containers is known and described among others in WO99/03746 (1998), WO99/03747 (1999), WO89/12584 (1989), WO03/022701, WO00/56616, WO/56615. The seals of these closures are all having in common that an annular sealing rib, which initially is projecting downwardly and inwardly with respect to the top portion of the closure, is turned inside-out during application onto a neck of a container.

A problem of closures known from prior art is that the seal of these closures often fails at high internal pressure and content leaks due to doming or lift-off of the top portion of the cap. Especially with caps which seal primarily on the inner peripheral surface or on the annular top surface of the neck of the container this problem may occur. A further problem often occurring with closures known from prior art is leakage of the seal due to high internal pressure in the container and additional top load applied to the top of the closure, e.g. due to stacking of several containers. The reason for this can be found in deformation of the closure and therewith related displacement of the seal. A further problem of the closures known from prior art is that the seal fails due to crooked application of the closure onto a neck of a container.

It is an object of the present invention to provide a sealing means for closures, especially closures for containers for carbonated beverages and other hot or cold liquids, which has an improved capability to adapt to necks of containers, especially necks of containers having a certain imperfection or damage.

It is a further object of the present invention to provide a sealing device and closure suitable for carbonated beverages and other hot or cold liquids, to offer advantages in production such as low cycle time and less material consumption and to be still pressure tight at high internal pressures and top load.

SUMMARY

The closure having a sealing device according to the present invention is suitable to be engaged with containers comprising a standardized neck of a container. The standardized neck comprises an outer peripheral surface with an external thread. The outer peripheral surface blends by an edge surface into an annular top surface which forms the upper end of the container when it is standing upright. Between the annular top surface and the external thread an outer free surface extends over a length of approximately 1 mm to 3 mm of the neck which is not covered by the thread and suitable for sealing purposes. Furthermore the neck of the container comprises a cylindrical, inner peripheral surface adjacent to the annular top surface.

Beside a sealing means according to the present invention the closure comprises in general a base with a disc like top portion and a therewith adjacent outer skirt with retaining means, such as an internal thread, suitable to be engaged with corresponding retaining means such as an external thread of the standardized neck of a container as described above. If appropriate the closure may have a hinged lid which is interconnected to the base of the closure and suitable to sealingly close an orifice.

Preferably the plastics material of the closure is high density polyethylene, low density polyethylene, polypropylene or a combination thereof. Where the container is to be used for gaseous liquids, the plastics material preferably has a very low porosity to the gas.

The herein described sealing means comprises in a first embodiment an essentially P-shaped cross-section. The sealing means comprises a cylindrical skirt extending in general perpendicular from the disk like top portion of the closure into the closure inside radially distanced to the outer skirt of the closure by a gap having a defined width and depth. The inner skirt, which in general has with respect to its cross section the form of a free standing lateral adjustable downward leg, is at its base preferably interconnected directly to the top portion of the closure. In the area of its opposite lower free end the inner skirt turns into at least one toroidal sealing ring which protrudes above the side surface of the cylindrical skirt. The toroidal sealing ring interacts in closed position radially from the outside with the outer free surface of the neck of the container via a designated contact surface, whereby this contact surface is arranged preferably as far down onto the free surface of the neck of the bottle as possible to reduce influence of known problems, e.g. doming, bottle finish damage at the upper outside rim, lifting of closure, which might occur. The cylindrical skirt acts as a base for the toroidal sealing ring and has a length which avoids negative interaction of the toroidal sealing ring with the thread of the neck of the container. The at least one toroidal sealing ring is preferably shaped such that it seals primarily due to annular tension. Therefore the sealing means is preferably freestanding even in radially deformed position when applied onto the neck of a container. In a preferred embodiment the gap between the inner and the outer skirt is designed such that no contact occurs between the sealing means and the outer skirt at any time.

The toroidal sealing ring comprises a protrusion which is arranged in engaged position towards the neck of the container and defines a contact zone. In difference to seals known form prior art which are mainly subject to annular pressure or bending forces in the root, the in general perpendicularly freestanding sealing means according to the present invention mainly seals due to annular tension forces occurring in the toroidal sealing ring when applied onto the neck of a container. The sealing means is designed such that it is capable to adjust/compensate a certain amount of lateral and/or radial offset or distortion of the neck of the container. The cylindrical skirt, which acts as the base, provides a certain flexibility in lateral/radial direction. Good results are achieved in that the proportion ratio vertical length to radial thickness of the base of the sealing means, which is arranged between the top portion of the closure and the toroidal sealing ring, is at least 1:1 preferably 4:1. Depending on the field of application further aspect ratios are relevant such as the radial thickness and shape of the base of the sealing means and the radial thickness of the annular sealing ring and the aspect ratio of the vertical length to the radial thickness of the annular sealing ring and the gap between the inner and the outer skirt.

In a further embodiment the seal has an in general R-shaped cross-section whereby the P-shaped cross-section blends at the inside into an inner top surface of the closure. Said blend is shaped such that it forms a second sealing region with the edge surface of the neck of the container which causes, when the edge surface presses onto the blend, the annular sealing ring to be pulled, due to controlled deformation of the base, inwardly onto the outer free surface of the neck of the container. Depending on the field of application the blend interconnects the base and the top surface smoothly by a concave shape having a radius or by a ramp like shape or by a convex shape protruding locally outwardly.

In a preferred embodiment the aspect ratio between the radial thickness of the annular sealing ring and the base is in the range of 2:1 and 3:1 (depending on the field of application other aspect ratios may be appropriate). The aspect ratio between the vertical free length of the annular sealing ring and its radial thickness is preferably in the range of 1:1 and 4:1. Depending on the field of application other aspect ratios are appropriate. The shape of the cross section of the annular sealing ring and the eccentricity of the contact surface with respect to the base of the sealing means is of further relevance for the field of application because these parameters influence the distribution of annular tension forces.

The shape and the alignment of the base of the sealing means is relevant for the performance and the physical behavior of the sealing means. E.g. if the base of the sealing means is inclined (conically) at an angle with respect to the top of the closure, the pop on of the closure onto the orifice (opening) of the container becomes more difficult and failures due to mismatch are more likely. One reason for this is that the distribution of forces and the initial widening of the seal become more difficult.

A preferred embodiment of the sealing means and the closure are made by an injection moulding process, respectively two-component injection moulding process, in a multi-component mould whereby a sealing liner is made in that a first plastic material is injected in liquid form into a first cavity onto a core of a mould cavity where the first material forming the liner congeals. Afterwards the liner is displaced with the first core into a second cavity position wherein a second material for an outer shell of the closure is injected into the second cavity. The material of the sealing liner and the material of the outer shell are thereby integrally joined to each other.

To optimize the production process the area in the cavity of the sealing-liner which is not in contact with the first core is preferably shaped such that the sealing-liner can be taken out of the first cavity without retaining forces. Therefore hindering undercuts mainly extending perpendicularly with respect to the displacing direction or the core are avoided. By the described injection moulding process a firm bonding is obtained between the liner and the shell material. In difference to the two-component closures as known from prior art made by a compression moulding process, the herein disclosed invention results in more reliable seal. Problems which typically occur when demoulding of closures made by compression moulding, where the shell of the closure is made first and the sealing liner second, do not occur with the herein described invention. The outer shell is preferably made out of Polypropylene (PP) or High Density Polyethylene (HDPE) whereby the liner is formed out of a softer material such as EVA, LDPE or a compounded material based on polyolefinic raw materials. The embodiment of the closure further comprises a sealing means which interacts with an outer thread-free peripheral cylindrical surface arranged between the thread and the annular top surface of the neck of the container.

A preferred embodiment of the sealing means for sealing of a neck of a container comprises a radially deformable outer sealing means suitable to be engaged with an outer free surface of the neck, whereby the outer sealing means has an in general P-shaped cross-section with an annular base and an annular sealing ring arranged at a free end of the annular base, protruding radially inwardly above the inner surface of the base and forming in engaged position with the neck a first sealing area with the outer free surface.

In a further preferred embodiment the sealing means has an outer sealing means with an in general R-shaped cross-section. A blend is arranged at the base and interconnects the base with a vertical top surface of the closure. The blend may form in engaged position of the sealing means and the neck a second sealing area between an edge surface of the neck and the outer sealing means. The outer sealing may be shaped such that by interaction between the edge surface and the blend the outer sealing means controllably deforms such that the annular sealing ring is pressed more firmly against the outer free surface of the neck. The blend can have, depending on the field of application, different shapes: e.g. a ramp-like cross-section, a convex cross-section or concave cross-section. When the blend is designed a smooth interconnection the, it preferably has a radius R which is larger than the radius of the edge surface of the neck of the container.

In a further embodiment the sealing means, respectively the closure may comprises a liner made out of a liner material. Thereby the liner may comprise an inner skirt which extends vertically along an outer downward leg. An annular sealing ring, made out of liner material, may be arranged a the end of the inner skirt.

In addition the sealing means may comprises a bore seal whereby the bore seal may be made out of liner material and may have a core made out of shell material.

DESCRIPTION OF THE DRAWINGS

The sealing means and the closure according to the present invention are explained in more detail according to preferred embodiments.

DESCRIPTION OF THE EMBODIMENTS

Figure 1:
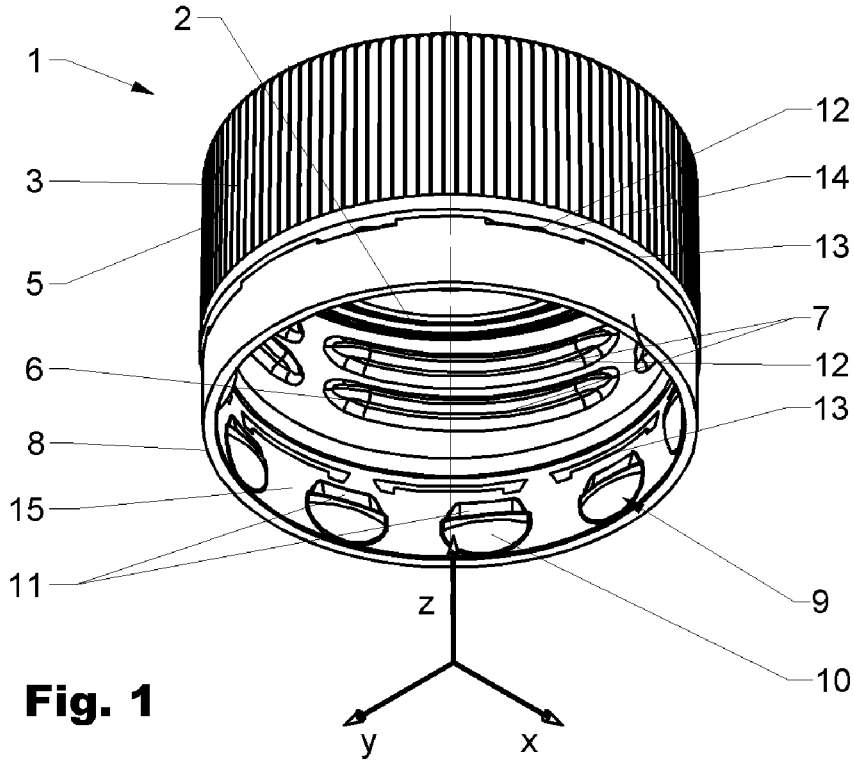
FIG. 1 shows a closure with a sealing means in a perspective view from below.
Figure 2:
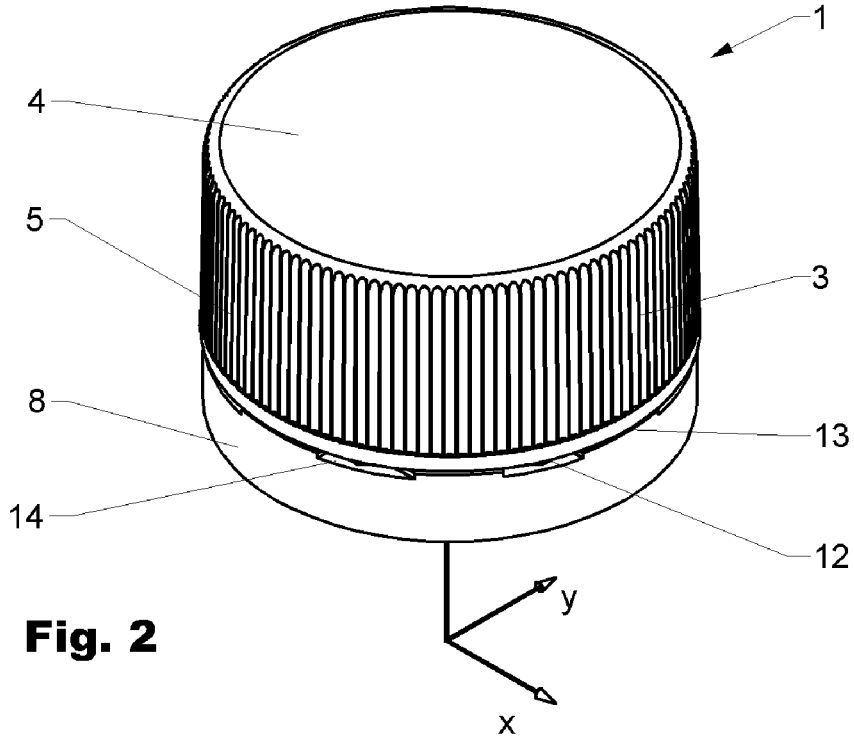
FIG. 2 shows the closure according to FIG. 1 in a perspective view from above.

FIG. 1 is showing a closure 1 comprising a sealing means 2 according to the present invention in an isometric side view from below and FIG. 2 the same closure 1 from a perspective side view from above. The closure 1 comprises an outer skirt 3 extending in general perpendicular from a disc-like top portion 4. The outer skirt 3 has on its outside vertically arranged knurls 5 which provide a better grip while operating the closure. On the inside the outer skirt 3 comprises a thread 6 consisting of thread segments 7. At its lower end the outer skirt is interconnected to a tamper band 8. The tamper band 8 of the displayed embodiment has in general the same outer diameter as the outer skirt 3 of the closure. On its inside the tamper band 8 comprises undercut segments 9 protruding radially inwardly and having a in general spherical lower part 10. During application of the closure onto the neck of a container (not visible) the spherical undercut segments support centering and alignment of the sealing means with respect to the neck of the container. Thereby failure due to tilt application can be significantly reduced. Above the undercut segments 9 centering elements 11, which protrude radially above the inner surface 15 of the tamper band 8, are arranged which are aligned to the closure axis z and which help to centre the closure 1 with respect to a locking bead of the neck of a container. Thereby tilting of the tamper band during opening of the closure 1 is reduced.

The tamper band 8 is interconnected to the outer skirt 3 of the closure 1 by frangible bridges 12 which are destroyed while initial opening of the closure 1. The tamper band 8 is distanced from the closure skirt 3 by a gap 13. The bridges 12 are arranged in the shown embodiment in recesses 14 which extend the length of the bridges 12 and thereby help to avoid unwanted disrupting of the bridges 12 during application of the closure 1.

Figure 3:
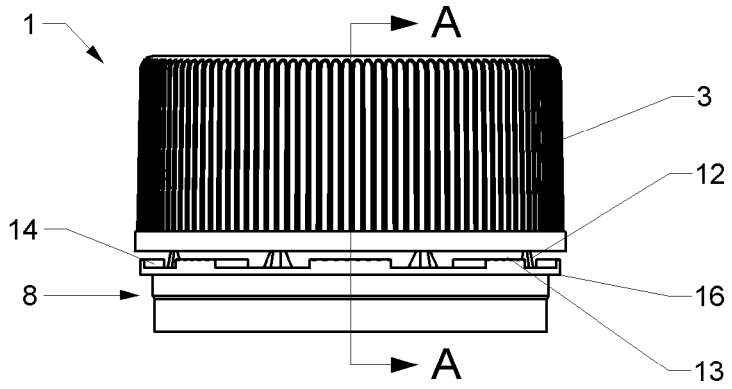
FIG. 3 shows a closure with a first embodiment of a sealing means in a side view.

FIG. 3 is showing a further embodiment of a closure 1 in a side view. The closure 1 comprises a tamper band 8 with an in general smaller outside diameter than the skirt 3 of the closure 1. The tamper band 8 comprises a shoulder 16 which suits as a contact point during ejection of the closure 1. The bridges 12 are similar to the closure according to FIGS. 1 and 2 arranged in recesses 14. The crosscut along line AA is shown in FIG. 4.

Figure 4:
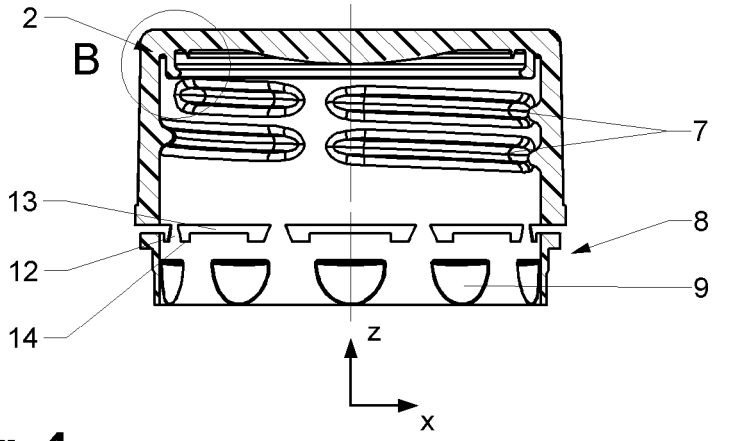
FIG. 4 shows a cross cut through the closure according to FIG. 3 along line AA.
Figure 5:
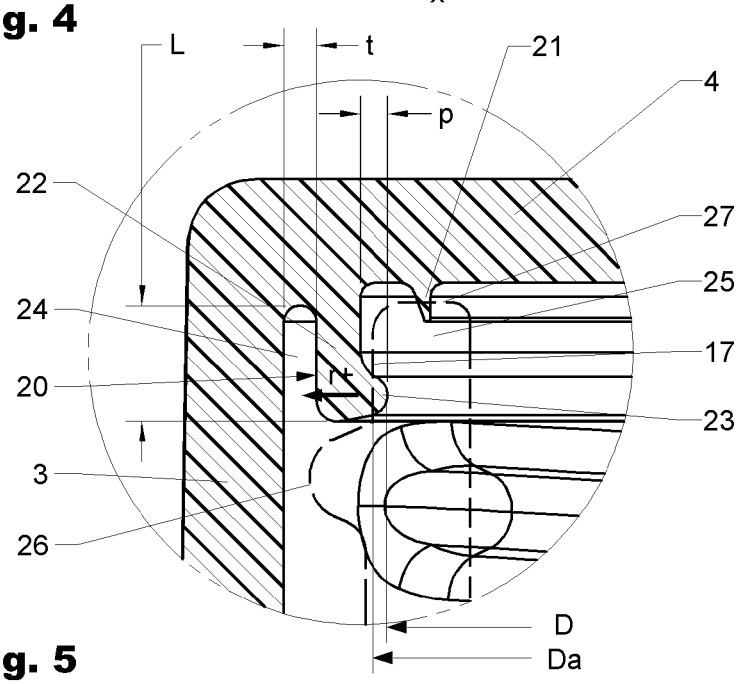
FIG. 5 shows detail B of FIG. 4.

FIG. 4 is showing a cross cut through the closure 1 and the sealing means 2 along line AA of FIG. 3 and FIG. 5 is showing detail B of the sealing means 2 of FIG. 3 in a magnified manner. In FIG. 5 a neck 25 (dashed line) of a container is schematically displayed. The sealing means 2 of the shown embodiment is displayed in an undeformed manner and comprises an outer side seal 20 and an in general V-shaped top seal 21 protruding from the inner surface of the disk like top portion 4 of the closure 1 in a generally perpendicular way inside the closure 1 and arranged such that it interacts in a closed position with the annular end surface 27 of the neck 25. The side seal 20 has an in general P-shaped cross-section and comprises a base 22 and an annular sealing ring 23 laterally protruding radially inwardly above the base 22 suitable to seal on an outer peripheral surface 17 of the neck 25 in a thread free area above thread 26. The side seal 20 is arranged radially distanced to the outer skirt 3. In the shown embodiment an annular gap 24 with in undeformed stage in general parallel side walls extends vertically between the side seal 20 and the outer skirt 3 of the closure 1 defining the outer free length L of the side seal 20. The thickness t of the annular gap 24 is chosen such that the annular sealing ring 23 and the base 22 may extend freely in radial direction r+ while the closure is applied onto the neck 25. The vertical length L of the base 22 of the side seal 20 is here chosen such that the annular sealing ring 23 is arranged as far as possible down along the free length of the outer vertical surface 17 of the neck 25 in the shown embodiment just above the start of the outside thread 26 container. The contact zone is on a PET-container, depending from the thread start, typically positioned about 0.5 mm to 2 mm below the annular end surface of the neck. By this arrangement the influence of doming or other deformation of the closure 1 may be minimised such that the seal 2 becomes over all more reliable. The laterally flexibly adjustable and vertically stiff base 22 of the side seal 20 guarantees that the annular sealing ring 23 may sideways adjust even while pop-on of the side seal 20 onto a neck of a container which is eccentric, especially in radial direction. The radial protrusion p of the annular sealing ring 23 over its base 22 is relevant for the interference with the neck 25. To obtain a radial sealing force the inner diameter D of the annular sealing ring 23 is smaller than the outer diameter Da of a neck of the container. If appropriate the vertical position of the sealing means 2 with respect the neck 25 is defined by an additional stop element.

Figure 6:
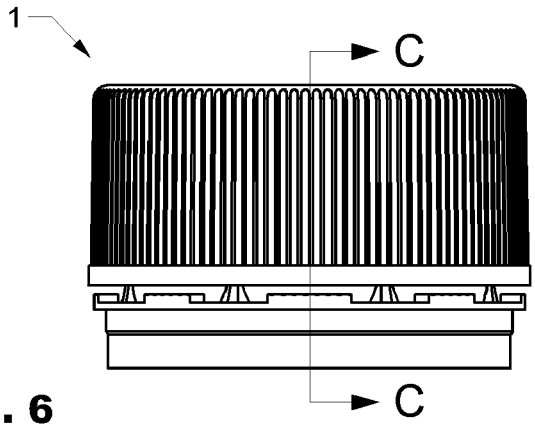
FIG. 6 shows a closure with a second embodiment of a sealing means in a side view.
Figure 7:
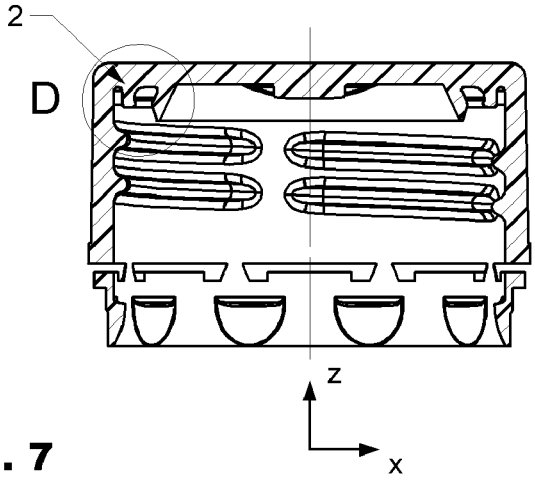
FIG. 7 shows a cross cut through the closure according to FIG. 6 along line CC.
Figure 8:
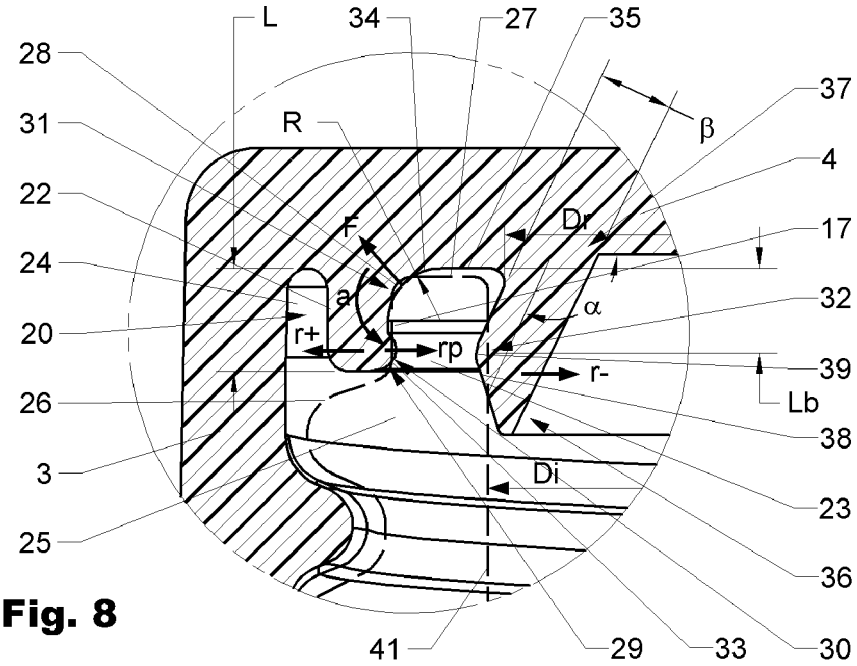
FIG. 8 shows detail D of FIG. 7.

FIG. 6 is showing a further embodiment of a closure 1 in a side view, FIG. 7 is showing a cross cut through the closure according to FIG. 6 along line CC and FIG. 8 is showing detail D of FIG. 7 in a magnified manner. The general setup of the closure 1 corresponds to the closure as described according to the FIGS. 1 to 5. The explanation of similar details such as outer skirt, tamper band and thread are therefore not repeated again and reference is made to these drawings.

As it can be seen in FIG. 8 the side seal 20 which has in the here shown embodiment of the sealing means 2 an in general R-shaped cross-section and is arranged radially distanced to the outer skirt 3. An annular gap 24 with in undeformed stage in general parallel side walls extends vertically between the side seal 20 and the outer skirt 3 of the closure 1. The annular gap 24 is chosen such that the annular sealing ring 23 and the base 22 may deform at least initially free in radial direction r while the seal is applied onto a neck 25 (schematically indicated by dashed line). The vertical length L of the base 22 of the side seal 20 is adjusted such that the annular sealing ring 23 is arranged as far as possible down along the free length 17 of the outer vertical surface of the neck 25 in the shown embodiment just above the start of the thread 26. In applied position a first sealing zone 30 is developed between the sealing means 2 and the neck 25 in that the annular sealing ring 23 is pressing against the outer free surface 17 of the neck 25 due to lateral stretching. As it can be seen base 22 blends on the inside by a blend 34 having here a radius R into a vertical top surface 35 of the closure 1. The blend 34 is shaped such that it is forming a second sealing area/contact region 31 in that it is in closed position in tight contact with an edge surface 28 interconnecting the outer free surface 17 and the annular top surface 27 of the neck 25. The radius R is in general larger than the radius of the edge surface 28 such that a precise interaction zone is determined. During the application process of the sealing means 2 onto the neck 25, the annular sealing ring 23 of the outside seal 20 is first in contact with the annular top surface 27 and/or the edge surface 28 of the neck 25. During further application the annular sealing ring 23 is circumferentially stretched until it slips onto the outer free surface 17 of the neck 25 establishing a first contact zone 30. During the further procedure the annular sealing ring 23 and the first contact zone 30 slips down along the outer free surface 17 of the neck 25 until the blend 34 is getting in contact with the outer edge surface 28 of the neck 25 establishing the second contact zone 31. In that the edge surface presses against the inner root (blend 34) of the outside seal 20, schematically indicated by arrow F, it is achieved that because of the geometry the annular sealing ring 23 is due to controlled deformation of the closure pulled inwardly (schematically indicated by arrow rp) and thereby pressed more firmly against the outer free surface 17 such that the sealing performance is improved. This functional interconnection between the first and the second contact zone is schematically indicated by arrow a. Before the second contact zone 31 is established the base 22 of the outside seal 20 is laterally adjustable and is locked in its final position due to the functional interconnection, when the second contact zone 31 is established. Thereby it is achieved that during application of the sealing device 2, before the second contact zone 31 is established, all advantages of the embodiment as described according to FIGS. 3 to 5 are maintained and in the final position, when the second contact zone is established and the outer seal 20 thereby locked 31, a further improved overall sealing performance results.

As it can be seen the annular sealing ring 23 protrudes locally above the inner side surface of the base 22. The protrusion 33 has in the shown embodiment an in general circular cross section which forms an appropriate first contact zone between the annular sealing ring 23 and the outer free surface 17 and still allows demoulding of the undercut. The annular sealing ring 23 further comprises a funnel shaped first lead in surface 29 suitable to establish a first contact between the outside seal 20 and the neck 25 and acting as a ramp for the annular sealing ring 23 such that it slides easily onto the outer free surface 17.

The shown sealing means 2 is further equipped with a bore seal 36 which reaches in a closing position down into the orifice of the neck 25. The bore seal 36 has an in general conical shape extending from it's root, where it is interconnected to the disk like top portion 4 of the closure 1, versus it's free end radially outwardly at an angle $\alpha$. The cross section of the base 37 of the bore seal 36 is in general V-shaped at an angle $\beta$ having it's apex in the region of the free end. The bore seal 36 further has a funnel shaped second lead in surface 38 which guarantees easy plug in of the bore seal 36 into the orifice of the neck 25. Adjacent to the second lead in surface 38 the bore seal is equipped with a here toroidal contact surface 39 forming in closed position a third contact zone 32 between the sealing means 2 and the inner side surface 41 of the neck 25. As it can be seen the sealing means 2 is shown in an undeformed stage and is due to that overlapping with the geometry of the neck 25. However, it is clear that the closure 1 adjusts during operation to the neck 25 due to elastic deformation of the closure material. The root diameter Dr of the bore seal 36 is chosen such that the bore seal 36 does not interact with the neck of the closure in the area of it's base. During application of the toroidal sealing means 20 onto the neck 25 the bore seal 36 is bent inwardly in the direction r– such it adjusts to the inner diameter Di of the orifice of the neck 25. In the herein described embodiment of the invention the in the closed position established third contact zone 32 is arranged approximately at the same vertical level (z-direction) as the first contact zone 30 of the outside seal 20. By this opposite arrangement at the same level the neck 25 is firmly hold which results in an increased tightness and sealing performance. The vent angle of the closure can be adjusted by the active length Lb which corresponds to the distance between third contact zone 32 and root of bore seal 36. To obtain a longer vent angle the active length Lb of the bore seal 36 is increased and to reduce a lower vent angle reduced (the vent angle corresponds to the angle the closure has to be turned until venting occurs). Depending on the field of application the bore seal can be avoided.

If the sealing means comprises in the area or adjacent to the intermediate top surface 35 an in general v-shaped protrusion (not shown in detail) which forms a top seal (fourth contact zone/sealing region) and interacts in the closing position with an annular top surface 27 of neck 25.

Figure 9:
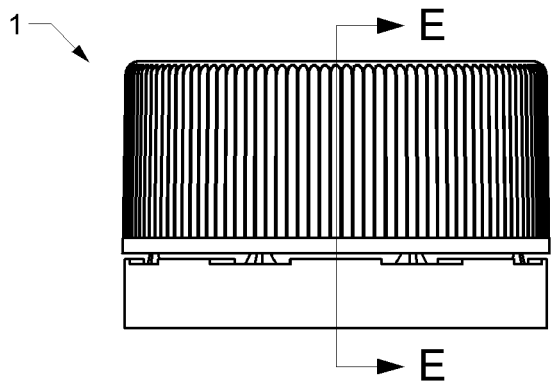
FIG. 9 shows a closure with a third embodiment of a sealing means in a side view.
Figure 10:
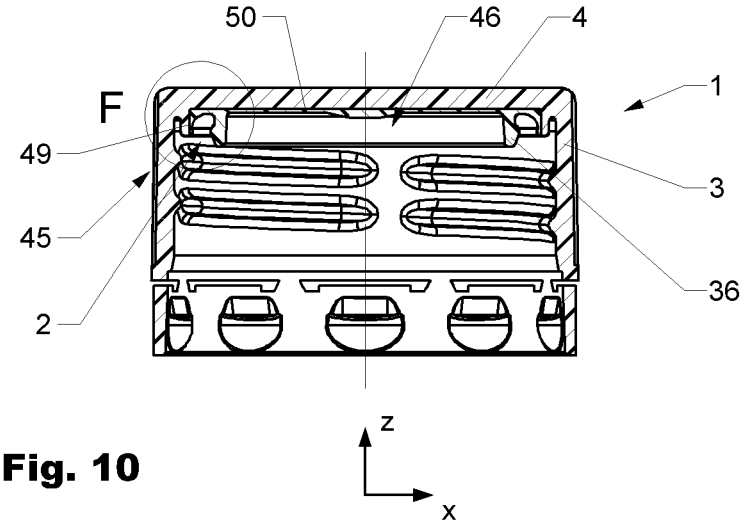
FIG. 10 shows a cross cut through the closure according to FIG. 9 along line EE.

FIG. 9 shows a further embodiment of a closure 1 comprising a sealing device according to the present invention in a side view made by two-component injection moulding. FIG. 10 is showing a cross cut through the closure according to FIG. 9 along line EE and FIG. 11 is showing detail F of FIG. 10 in a magnified manner.

Figure 11:
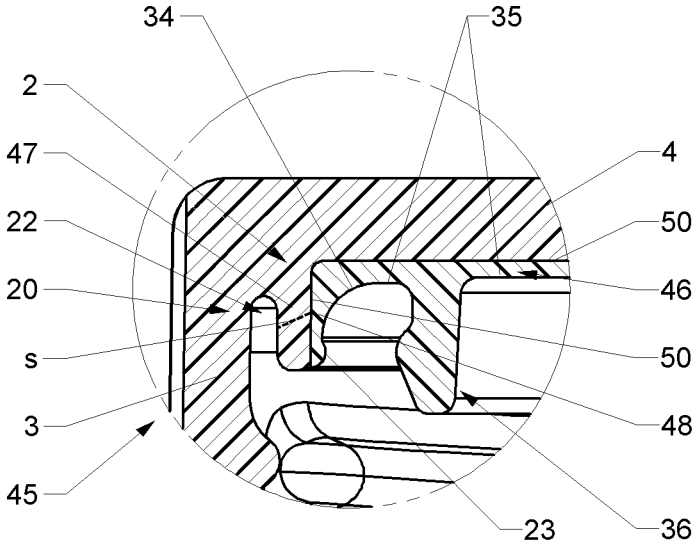
FIG. 11 shows detail F of FIG. 10.

A detailed explanation of how a sealing means as shown in the FIG. 9 to 11 can be best made is explained in full detail in the international patent application PCT/EP2005/051559 of the same inventor as the herein disclosed invention which is now incorporated in full and with all embodiments into the present patent application.

The attention is now directed to FIG. 11. The cross section and the functionality of the sealing means 2 as shown in FIG. 11 corresponds to the sealing means shown in FIG. 8 with the only difference that the sealing means 2 is made here out of two materials (shell material and liner material). With respect to the functionality it is therefore referred to FIG. 8 and the explanation belonging to it.

In difference to the closures described according to the previous FIGS. 1 to 8 the sealing means 2 of the closure according to the FIGS. 9 to 11 is made out of two materials preferably by two-component injection moulding having an outer shell 45 (disk like top portion 4 and outer skirt 3) made out of a shell material and a sealing liner 46 made out of liner material which covers here all surfaces exposed to the good stored in the container to be sealed. The outer shell 2 of the closure 1 is preferably made out of Polypropylene (PP) or High Density Polyethylene (HDPE) whereby the sealing liner 46 is preferably formed out of a softer liner material such as Darex™. The outer shell 45 and the sealing liner 46 are, as shown here, firmly bonded to each other along their boundary surfaces 49, 50 such that a save application and positioning of the sealing means 2 becomes possible.

The base 22 of the sealing means 20 comprises an outer downward leg 47 made out of shell material which supports an inner skirt 48 made out of liner material. The downward leg 47 supports and stabilizes the inner skirt 48 and the toroidal sealing ring 23 made partially out of liner material and arranged at the end of the base 22 in lateral and vertical direction. As it can be seen the liner 46 is formed such that it extends in xy-direction along the inner top surface 35 of the closure 1 and down along the outer downward leg 47 (–z-direction). The inner skirt 48 blends by blend 34 into the vertical top surface 35. Both the inner skirt 48 and the inner base 22 are shown in an undeformed manner but will be extended radially outwardly during application onto a neck of a closure. The vertical boundary surface 49 between the outer downward leg 47 of the sealing liner 46 and the inner skirt 48 of the shown embodiment is in general straight and slightly tapered such that the liner 46 can easily be taken out of the mould after moulding in the first stage. Depending on the field of application the boundary surface can have a different shape such as indicated by line s such that the lower end of the outer seal 20 is made completely out of shell material and supported only in it's lower end by the outer downward leg 47.

As explained in connection with FIG. 8 the sealing means may comprise in the area or adjacent to the intermediate top surface 35 an in general v-shaped protrusion (not shown in detail) which forms a top seal (fourth contact zone) and interacts in the closing position with an annular top surface 27 of neck 25 (see FIG. 8).

The sealing means 2 further comprises in the shown embodiment a bore seal 36 which has, in difference to the embodiment shown in FIGS. 6 to 8, an in general olive shaped cross section. As it can be seen the bore seal 36 is integrated into liner disc 46. If appropriate the bore seal 36 may comprise a section made out of shell material to obtain increased lateral support. Alternatively or in addition the bore seal may be supported by lateral ribs (not shown in detail).

The invention claimed is:

1. A closure for sealingly closing a neck of a container comprising:

a disc like top portion;

an adjacent skirt with retaining means configured and operable to engage the neck of the container; and a sealing device, the sealing device comprising;

a radially deformable side seal configured for engagement with an outer free surface of the neck of the container, the side seal includes:

an annular base radially distanced from the skirt by a gap;

an annular sealing ring arranged at a free end of the annular base, the sealing ring including an inwardly facing convex surface extending radially inwardly from an inner surface of the annular base and forming, when in an engaged position with the neck, a first sealing area with the outer free surface of the neck, and a blend arranged at the inside of the annular base, the blend including an arcuate inner surface extending between a substantially vertical inner surface of the annular base and a substantially horizontal inner surface of the disc like top portion interconnecting the annular base with the disc like top portion of the closure, the arcuate inner surface of the blend having a predetermined radius and forming, when the sealing device and neck are engaged, a second sealing area between an edge surface of the neck and the side seal, the arcuate inner surface of the blend is configured such that by interaction with the edge surface of the neck of the container, the side seal controllably deforms such that the inwardly facing convex surface of the annular sealing ring is pressed radially inward more firmly against the outer free surface of the neck.

2. The closure according to claim 1 further comprising a liner made out of a liner material which is firmly bonded to a closure shell made out of a shell material by a two-component injection molding process.

3. The closure according to claim 1, wherein the predetermined radius of the arcuate inner surface of the blend is larger than a radius of the edge surface of the neck of the container.

4. The closure according to claim 1, wherein the annular sealing ring has a funnel shaped lead-in surface.

5. The closure according to claim 1, wherein the sealing device comprises a liner made out of a liner material.

6. The closure according to claim 5, wherein the side seal comprises an inner skirt made of a liner material which extends vertically along an outer downward leg made out of a shell material.

7. The closure according to claim 5, wherein the annular sealing ring is made out of a liner material.

8. A method for applying a closure according to claim 1 onto a neck of a container, the method comprising:

a) aligning the closure above the neck;

b) moving the closure relatively to the neck until a contact between the second sealing area and the edge surface of the neck is established; and, c) further moving the closure relatively to the neck such that the annular sealing ring is circumferentially stretched until it slips onto the outer free surface of the neck to establish the first sealing.

9. The method according to claim 8 wherein the closure is moved relatively to the neck until the second sealing area is established between the edge surface and the blend.

10. The method according to claim 9 wherein the edge surface is pressed against the blend and the outer sealing means controllably deforms such that the annular sealing ring is pressed more firmly against the outer free surface.

11. The closure according to claim 1, wherein the sealing device comprises a bore seal.

12. The closure according to claim 11, wherein the bore seal has a generally conical shaped base protruding radially outwardly at an angle and a generally funnel shaped lead-in surface, and the base and the lead-surface are interconnected by a toroidal contact surface proximate a largest diameter of the bore seal with said base having a continuously decreasing thickness versus ifs lower free end.

13. The closure according to claim 11, wherein the bore seal has a generally olive-shaped cross-section.

14. The closure according to claim 11, wherein the bore seal is supported by lateral ribs.

15. The closure according to claim 11, wherein the bore seal is made out of a liner material.

16. The closure according to claim 15, wherein the bore seal has a core made out of a shell material.

* * * * *

UNITED STATES PATENT AND TRADEMARK OFFICE

CERTIFICATE OF CORRECTION

PATENT NO. : 8,393,483 B2
APPLICATION NO. : 11/574569
DATED : March 12, 2013
INVENTOR(S) : Rodney Druitt It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1067 days.

Signed and Sealed this
First Day of September, 2015

Michelle K. Lee

Michelle K. Lee
*Director of the United States Patent and Trademark Office*